US009737174B2

(12) United States Patent
Wei

(10) Patent No.: US 9,737,174 B2
(45) Date of Patent: Aug. 22, 2017

(54) TRACK CORNER CONNECTING DEVICE FOR SHOWER DOOR, SHOWER DOOR FRAME AND SHOWER DOOR

(71) Applicant: Ideal Sanitary Ware Co., Ltd., Foshan (CN)

(72) Inventor: Wuxiang Wei, Foshan (CN)

(73) Assignee: Ideal Sanitary Ware Co., Ltd. (CN)

( * ) Notice: Subject to any disclaimer, the term of this patent is extended or adjusted under 35 U.S.C. 154(b) by 0 days.

(21) Appl. No.: 15/100,549

(22) PCT Filed: Jan. 28, 2015

(86) PCT No.: PCT/CN2015/071770
§ 371 (c)(1),
(2) Date: May 31, 2016

(87) PCT Pub. No.: WO2016/119151
PCT Pub. Date: Aug. 4, 2016

(65) Prior Publication Data
US 2016/0362922 A1 Dec. 15, 2016

(51) Int. Cl.
*A47K 3/34* (2006.01)
*A47K 3/30* (2006.01)
(Continued)

(52) U.S. Cl.
CPC ..... *A47K 3/34* (2013.01); *A47K 3/30* (2013.01); *E05D 15/0652* (2013.01); *E05D 15/0656* (2013.01); *E06B 3/9636* (2013.01); *E06B 3/9641* (2013.01); *E06B 3/9642* (2013.01); *E06B 3/9687* (2013.01); *E06B 3/4636* (2013.01)

(58) Field of Classification Search
CPC ..... A47K 3/283; A47K 3/284; A47K 3/34; A47K 3/36; A47K 3/30; A47K 2003/307; F16B 12/46; F16B 12/50; F16B 2/22; F16S 3/06
See application file for complete search history.

(56) References Cited

U.S. PATENT DOCUMENTS 4,611,947 A * 9/1986 Baus ..... A47K 3/34 403/104
4,993,201 A * 2/1991 Bunyard ..... A47K 3/284 4/596

(Continued)

FOREIGN PATENT DOCUMENTS

CN 103519728 A 1/2014
CN 203476960 U 3/2014

(Continued)

OTHER PUBLICATIONS

International Search Report for Application No. PCT/CN2015/071770 dated Nov. 9, 2015.

*Primary Examiner* — Justin Rephann
(74) *Attorney, Agent, or Firm* — Lerner, David, Littenberg, Krumholz & Mentlik, LLP

(57) ABSTRACT

This invention relates to the field of sanitary and bathing devices, and particularly to a track corner connecting device for a shower door used in a shower room, a shower door frame and a shower door. The track corner connecting device for a shower door comprises: an inserting member and a receiving member, wherein: the inserting member comprises an insert, the insert having a chamber therein and being provided with a first opening; the receiving member comprises a receiver, the receiver having a receiving chamber therein and being provided with a second opening and a third opening, the second and third openings being arranged on two adjacent walls of the receiver; the receiving member further comprises a fixture; and an exit-stopping projection is provided on a second wall of the receiving member.

20 Claims, 8 Drawing Sheets

(51) Int. Cl.

| | |
|---|---|
| ***E05D 15/06*** | (2006.01) |
| ***E06B 3/96*** | (2006.01) |
| ***E06B 3/964*** | (2006.01) |
| ***E06B 3/968*** | (2006.01) |
| *E06B 3/46* | (2006.01) |

(56) References Cited

U.S. PATENT DOCUMENTS

| | | | | |
|---|---|---|---|---|
| 7,877,825 | B1 * | 2/2011 | Marshall | A47K 3/30 4/612 |
| 2006/0225378 | A1 * | 10/2006 | Hu | B65D 7/14 52/648.1 |
| 2014/0250585 | A1 * | 9/2014 | Slothower | A47K 3/283 4/614 |
| 2014/0331598 | A1 * | 11/2014 | White | E04F 13/0805 52/775 |
| 2016/0296079 | A1 * | 10/2016 | Wei | A47K 3/30 |
| 2016/0353938 | A1 * | 12/2016 | Wei | A47K 3/34 |
| 2016/0363150 | A1 * | 12/2016 | Schindler | H02B 1/014 |

FOREIGN PATENT DOCUMENTS

| | | | |
|---|---|---|---|
| CN | 203515227 | U | 4/2014 |
| CN | 103953267 | A | 7/2014 |
| EP | 2530232 | A1 | 12/2012 |
| EP | 2672055 | A1 | 12/2013 |
| JP | 2004225295 | A | 8/2004 |

* cited by examiner

TRACK CORNER CONNECTING DEVICE FOR SHOWER DOOR, SHOWER DOOR FRAME AND SHOWER DOOR

CROSS-REFERENCE TO RELATED APPLICATIONS

The present application is a national phase entry under 35 U.S.C §371 of International Application No. PCT/CN2015/071770 filed Jan. 28, 2015, the disclosure of which is hereby incorporated herein by reference.

TECHNICAL FIELD

This invention relates to the field of sanitary and bathing devices, and particularly to a shower door installed in a shower room, a shower door frame for such a shower door and a track corner connecting device for such a shower door.

BACKGROUND ARTS

Today, people usually provide shower rooms in washing rooms when performing decoration. Existing shower rooms usually use shower doors with glass panels. Most existing shower doors can be divied into two types, namely, sliding doors with tracks and hinge doors with hinges.

A hinge door includes a metal frame within which a glass panel is provided. Usually at least one glass panel is a fixed glass panel fixed within the frame; that is, the fixed glass panel cannot move relative to the frame. In addition, at least one movable glass panel that can rotate relative to the fixed glass panel is provided within the frame, and the movable glass panel and the fixed glass panel are connected by two or more hinges. When opening or closing the shower door, it only needs to push the movable glass panel to rotate around the axes of the hinges.

A sliding door includes a metal frame including one or two tracks provided at an upper end or a lower end of the sliding door. The track(s) is/are substantially parallel with the ground. In addition, side frames are provided at both sides of the frame respectively, are perpendicular with the tracks, and are fixedly connected to the tracks. At least two glass panels are provided within the frame. Multiple glass panels may be movable ones that can slide back and forth in the tracks. In another case, at least one fixed glass panel that cannot slide relative to the tracks may be provided. If a fixed glass panel is provided, the shower door should at least include one movable glass panel that can slide back and forth in the tracks.

It is possible for both a shower door having a hinge door structure and a shower door having a sliding door structure to include a shower door with a bending structure. As show in FIG. 1, such a shower door includes a plurality of tracks, wherein the upper track includes two tracks 10 and 11 forming an included angle therebetween and the lower track includes two tracks 12 and 13 forming an included angle therebetween. The shower door is provided with side frames 14 and 15 extending in a perpendicular direction at both sides of the shower door adjacent to the walls, a glass panel 16 is mounted in the tracks 10 and 12 and the side frame 14, and a glass panel 17 is mounted in the tracks 11 and 13 and the side frame 15. A connecting device 18 is provided at a corner between the tracks 10 and 11, and a connecting device 19 is also provided at a corner between the tracks 12 and 13.

Since the included angle between the tracks 10 and 11 may be an angle such as 90° or 135°, the current connecting devices 18 and 19 are designed into required angles according to the included angles between the tracks, and are provided with screw holes thereon. When mounting the shower door, the tracks and the connecting devices are connected using screws, but such a method is time-and-labor-consuming for installation staff.

Other available connecting devices are designed to have a plurality of components, wherein one component is connected with a track while another component with another track, then a third component is used to connected the above two components, thereby achieving connection between the two tracks. Although such a method spares screws in field installation, the connecting device has a large number of components, and some connecting devices even need to be assembled in advance; therefore, mounting the shower door will take a long time, and the cost for producing and mounting the shower door will increase.

Technical Problems

To solve the above problems, the main objective of this invention is to provide a track corner connecting device for a shower door with a small number of parts and convenient assembly.

Another objective of this invention is to provide a shower door frame having a track with a corner, requiring no installation tool and no screws when installing.

A further objective of this invention is to provide a shower door with short installation time and low manufacturing cost.

Technical Solutions

To realize the main objective of this invention, this invention provides a track corner connecting device for a shower door, comprising: an inserting member and a receiving member, the inserting member being fixedly connected to a first track of the shower door, the receiving member being fixedly connected to a second track of the shower door, wherein: the inserting member comprises an insert, the insert having a chamber therein and being provided with a first opening; the receiving member comprises a receiver, the receiver having a receiving chamber therein and being provided with a second opening and a third opening, the second and third openings being arranged on two adjacent walls of the receiver, and the inserting member being capable of passing through the second opening so as to be mounted in the receiving chamber; the receiving member further comprises a fixture which is arranged at one side of the third opening, is connected to a first wall of the receiver, and is capable of rotating around a side of the first wall of the receiver and being snap-fitted in the chamber of the inserting member; and an exit-stopping projection is provided on a second wall of the receiving member opposite the first wall, an end of the fixture abutting against the exit-stopping projection.

According to a preferred solution, the end of the fixture is provided with an unlocking member which is connected to the end of the fixture through a first sheet and is capable of rotating around the first sheet.

According to a further solution, the unlocking member is provided with an unlocking projection which is capable of abutting against the exit-stopping projection of the receiving member.

According to a yet further solution, the fixture comprises a first connecting piece and a second connecting piece that are interconnected, at least one side of the first and second connecting pieces is connected to an elastic piece, and the elastic piece is provided with at least one cut.

According to a yet further solution, at least one first position limiting projection is provided on a surface of the inserting member adjoining the first track, and at least one second position limiting projection is provided on a surface of the receiving member adjoining the second track.

According to a yet further solution, the connecting device further comprises a decorating cover encapsulating the receiving member, the decorating cover is provided with a latch therein; the inserting member and/or the receiving member is/are provided with an open slot/open slots into which the latch is inserted.

According to a yet further solution, a lower end of the decorating cover is provided with an exit-stopper, and a lower end of the receiving member is provided with a step portion to which the exit-stopper is snap-fitted.

To realize another objective of this invention, this invention provides a shower door frame, comprising: a track extending in a horizontal direction and a side frame arranged to be perpendicular with the track, the track comprising a first track and a second track with an included angle formed therebetween, the first and second tracks being connected by a connecting device; wherein: the connecting device comprises an inserting member and a receiving member, the inserting member being fixedly connected to the first track, the receiving member being fixedly connected to the second track; the inserting member comprises an insert, the insert having a chamber therein and being provided with a first opening; the receiving member comprises a receiver, the receiver having a receiving chamber therein and being provided with a second opening and a third opening, the second and third openings being arranged on two adjacent walls of the receiver, and the inserting member being capable of passing through the second opening so as to be mounted in the receiving chamber; the receiving member further comprises a fixture which is arranged at one side of the third opening, is connected to a first wall of the receiver, and is capable of rotating around a side of the first wall of the receiver and being snap-fitted in the chamber of the inserting member; and an exit-stopping projection is provided on a second wall of the receiving member opposite the first wall, an end of the fixture abutting against the exit-stopping projection.

To realize another objective of this invention, this invention provides a shower door, comprising: a track extending in a horizontal direction and a side frame arranged to be perpendicular with the track, a glass panel being mounted within the side frame, the track comprising a first track and a second track with an included angle formed therebetween, and the first and second tracks being connected by a connecting device; wherein: the connecting device comprises an inserting member and a receiving member, the inserting member being fixedly connected to the first track, the receiving member being fixedly connected to the second track; the inserting member comprises an insert, the insert having a chamber therein and being provided with a first opening; the receiving member comprises a receiver, the receiver having a receiving chamber therein and being provided with a second opening and a third opening, the second and third openings being arranged on two adjacent walls of the receiver, and the inserting member being capable of passing through the second opening so as to be mounted in the receiving chamber; the receiving member further comprises a fixture which is arranged at one side of the third opening, is connected to a first wall of the receiver, and is capable of rotating around a side of the first wall of the receiver and being snap-fitted in the chamber of the inserting member; and an exit-stopping projection is provided on a second wall of the receiving member opposite the first wall, an end of the fixture abutting against the exit-stopping projection.

Advantageous Effects

The connecting device for use in a shower door provided in this invention has an inserting member and a receiving member, wherein the inserting member can be inserted into the receiving member, a fixture of the receiving member can rotate around one side and can be snap-fitted in the chamber of the inserting member to fix the inserting member in the receiving member. Since the inserting member is fixedly connected with the first track, and the receiving member is fixedly connected with the second track, connection between the first track and the second track of the shower door can be realized simply by way of connection between the inserting member and the receiving member.

Thus, when assembling the shower door frame, first, the inserting member is fixed at one end of the first track, and the receiving member at one end of the second track; then, the inserting member is inserted into the receiving chamber of the receiving member; finally, the fixture of the receiving member is snap-fitted downwards in the chamber of the inserting member, so that assembling of the two tracks is realized simply. As no screw and tool will be required for the installation between the two tracks, the installation of the shower door frame consumes less time, and the assembling operation is simple, so that the costs for the production and installation of the shower door can be reduced.

Besides, since the track corner connecting device only includes one inserting member and one receiving member, it requires fewer components, and can further reduce the production cost of the shower door.

Further, as an end of the fixture is provided with an unlocking member, when detaching the connecting device, the unlocking member can be released from the receiving chamber by only rotating the unlocking member, so that the fixture can be released from the chamber of the inserting member, and the inserting member can be taken out of the receiving chamber easily. Therefore, the detaching of the connecting device is simple and convenient.

In addition, by providing a decorating cover outside the inserting member and the receiving member, the inserting member and the receiving member can be encapsulated for decoration purposes, and the latch can be inserted into the open slots of the inserting member and the receiving member, so that the inserting member and the receiving member are fixed, and relative movement between the inserting member and the receiving member is prevented, thereby providing secure fixing of the connecting device.

This invention will be further explained in combination with the figures and the embodiments.

PREFERRED EMBODIMENTS

The shower door of this invention is mounted in a shower room, is in a bent shape and has a shower door frame and a glass panel mounted in the shower door frame. The shower door frame includes a track extending in a horizontal direction and a side frame arranged to be perpendicular to the track. The track includes an upper track mounted at an upper side of the glass panel and a lower track mounted at a lower side of the glass panel, wherein the upper track includes a first track and a second track forming an included angle therebetween, the included angle is 90° or 135°, and the first and second tracks are connected by a connecting device. The lower track also includes a first track and a second track forming an included angle therebetween, the included angle is 90° or 135°, and the first and second tracks are also connected by a connecting device. This invention mainly improves the connecting device that connects the first track with the second track, and the structure of the connecting device will be described in detail in the followings.

First Embodiment

Figure 1:
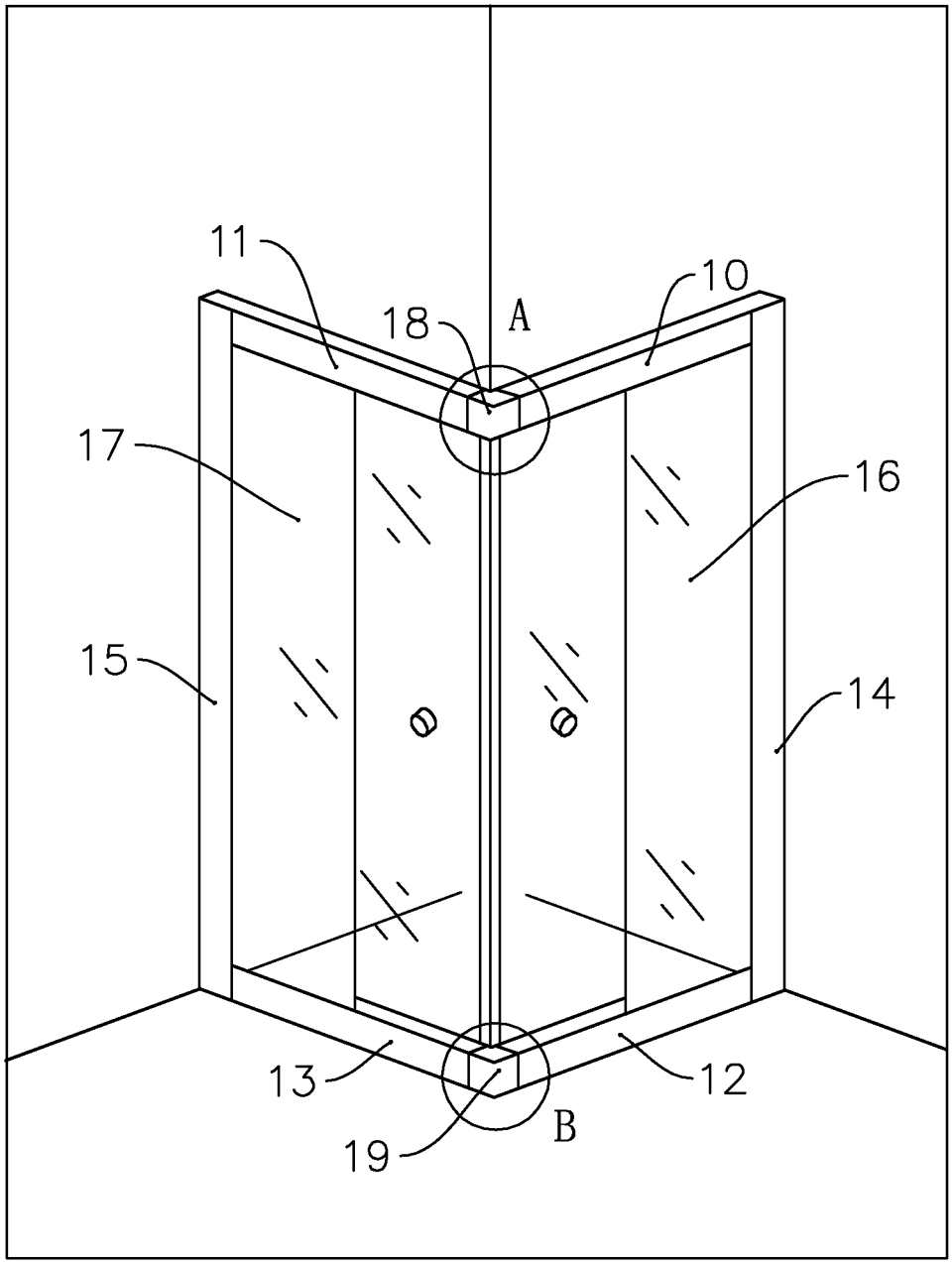
FIG. 1 is a structural view of an existing shower door mounted in a shower room.
Figure 2:
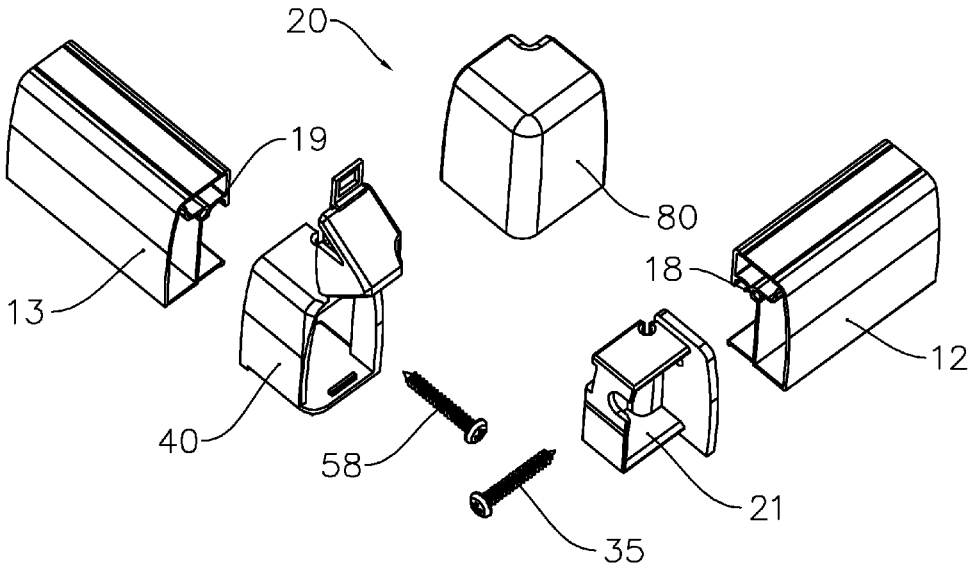
FIG. 2 is a structural exploded view of a first embodiment of the track corner connecting device for a shower door of this invention and a track.

Referring to FIG. 2, the connecting device 20 of this embodiment is used to connect the first track 12 and the second track 13, and comprises an inserting member 21, a receiving member 40 and a decorating cover 80 encapsulating the inserting member 21 and the receiving member 40. An end of the first track 12 is provided with a threaded hole 18. The inserting member 21 is fixed to the end of the first track 12 by a screw 35, which may be screwed in the threaded hole 18. An end of the second track 13 may be provided with a threaded hole 19 too. The receiving member 40 is fixed to the end of the second track 13 by a screw 58.

Of course, the inserting member 21 may be fixed to an end of the first track 12 by a rivet or welding, may be fixed to the end of the first track 12 at the installation site of the shower door or may be fixed to the end of the first track 12 in advance. The receiving member 40 may be fixed to an end of the second track 13 by a rivet or welding, may be fixed to the end of the second track 13 at the installation site of the shower door or may be fixed to the end of the second track 13 in advance.

Figure 3:
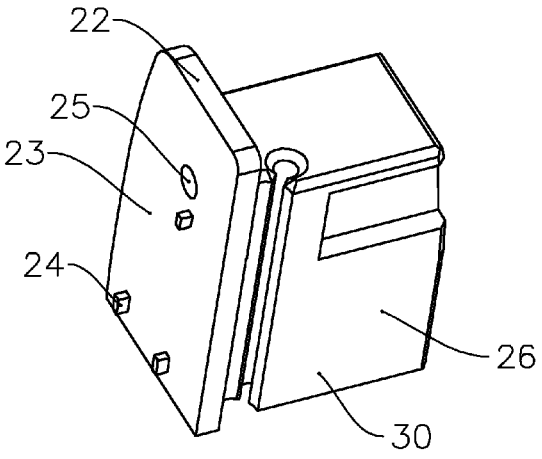
FIG. 3 is a structural view of an inserting member of the first embodiment of the track corner connecting device for a shower door of this invention from a first view angle.
Figure 4:
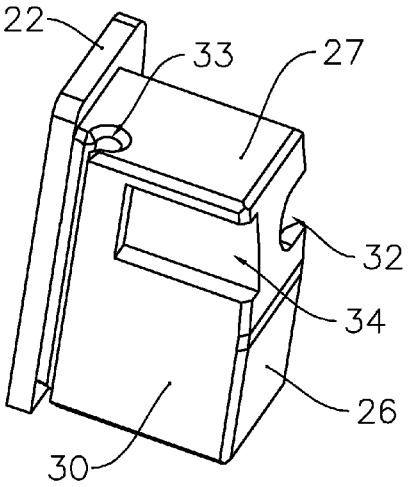
FIG. 4 is a structural view of an inserting member of the first embodiment of the track corner connecting device for a shower door of this invention from a second view angle.
Figure 5:
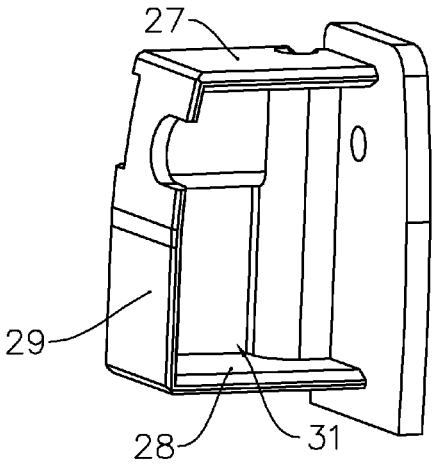
FIG. 5 is a structural view of an inserting member of the first embodiment of the track corner connecting device for a shower door of this invention from a third view angle.

Referring to FIGS. 3-5, the inserting member 21 may have a sheet-like body 22 and an insert 26 provided at one side of the body 22. Three position-limiting projections 24 are provided at an end face 23 of the body 22 close to the first track 12. After the inserting member 21 is mounted to the end of the first track 12, the three position-limiting projections 24 can restrict movement of the inserting member 21 relative to the first track 12, thereby preventing the inserting member 21 from rotating. The body 22 also includes a through hole 25. The screw 35 may pass through the through hole 25 and may be screwed in the threaded hole 18.

The insert 26 extends outwards from a side of the body 22 opposite the end face 23, is enclosed by a top wall 27, a bottom wall 28 opposite the top wall 27, side walls 29, 30 and the body 22, and encloses a chamber 31 that has an opening. Specifically, the chamber 31 has the opening at its end opposite the side wall 30. Thus, the insert 26 has an opening, which is said opening. Of course, the side wall 30 may not be necessary and may be omitted in application.

A screw dodging hole 32 is provided to the side wall 29, and a screw dodging hole 34 is also provided to the side wall 30, so that the screw 35 can smoothly pass through the insert 26 and can be screwed in the threaded hole 18 during installation. In addition, an open slot 33 is provided to the top wall 27, so that the decorating cover 80 can fix the inserting member 21.

Figure 6:
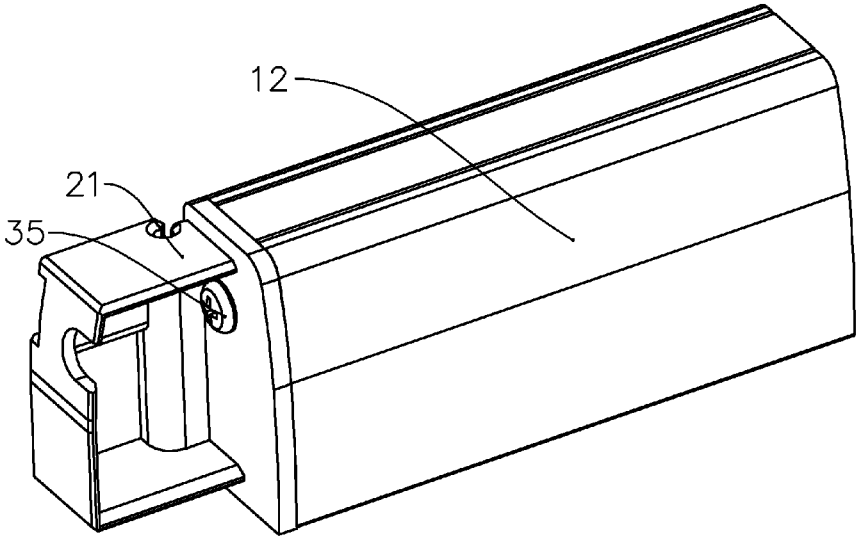
FIG. 6 is a structural view in which an inserting member of the first embodiment of the track corner connecting device for a shower door of this invention is mounted to the first track.
Figure 7:
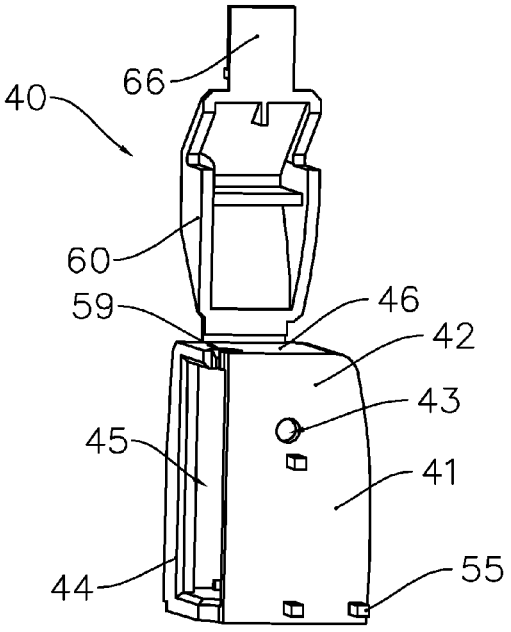
FIG. 7 is a structural view of a receiving member of the first embodiment of the track corner connecting device for a shower door of this invention from a first view angle.
Figure 8:
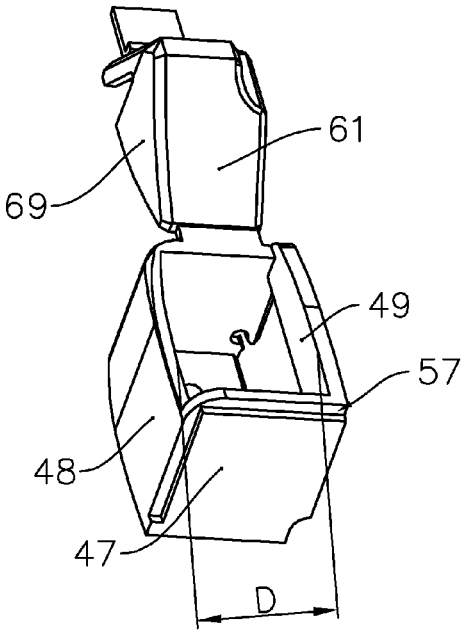
FIG. 8 is a structural view of a receiving member of the first embodiment of the track corner connecting device for a shower door of this invention from a second view angle.

When assembling the shower door frame, the inserting member 21 needs to be fixed at the end of the first track 12 by the screw 35 first, as shown in FIG. 6, before other members of the shower door frame are installed.

Referring to FIGS. 7-10, the receiving member 40 has a body 41 and a receiver 44 at one side of the body 41. The body 41 is a sheet-like body. Three position-limiting projections 55 are provided at a surface 42 of the body 41 close to the second track 13. After the receiving member 40 is mounted to the second track 13, the three position-limiting projections 55 can limit movement of the receiving member 40 relative to the second track 13, thereby preventing the receiving member 40 from rotating relative to the second track 13. In addition, the body 41 further includes a through hole 43. The screw 58 may pass through the through hole 43 and may be screwed in the threaded hole 19 so as to fix the receiving member 40 to the second track 13.

Figure 9:
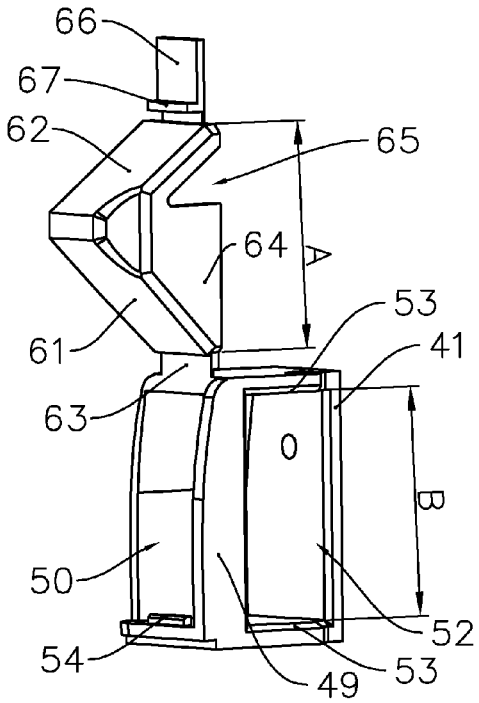
FIG. 9 is a structural view of a receiving member of the first embodiment of the track corner connecting device for a shower door of this invention from a third view angle.
Figure 10:
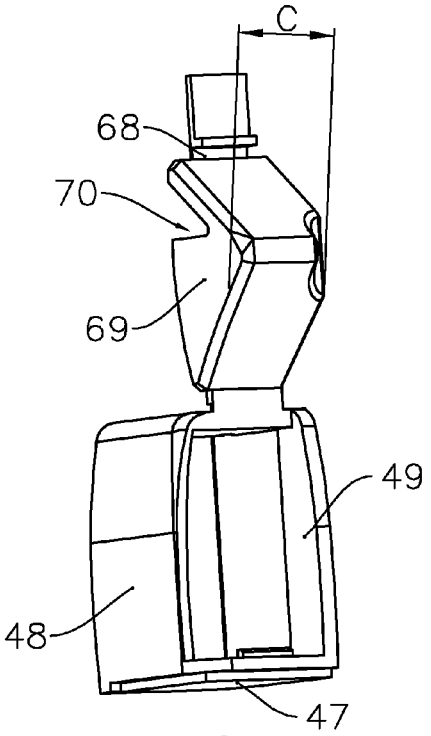
FIG. 10 is a structural view of a receiving member of the first embodiment of the track corner connecting device for a shower door of this invention from a fourth view angle.

A receiver 44 is provided at a side of the body 41 away from the second track 13, includes a top wall 46, a bottom wall 47 opposite the top wall 46, side walls 48, 49 and the body 41, and encloses a receiving chamber 45. No side wall is provided at a surface opposite the body 41, so the receiving chamber 45 has an opening 50 opposite the body 41. In addition, the side wall 49 is also provided with an opening 52. As shown in FIG. 9, the openings 50, 52 are provided at two adjacent side walls. The inserting member 21 may be inserted into the receiving chamber 45. In this embodiment, the inserting member 21 can pass through the opening 52 and is inserted into the receiving chamber 45.

A fixture 60 is provided above the receiver 44. The fixture 60 in this embodiment is generally triangular prismatical, and includes interconnected first and second connecting pieces 61, 62. The first connecting piece 61 is connected to the top wall 46 by a sheet 63, which is flexible, so that the fixture 60 can rotate about one side wall of the top wall 46. In other words, the sheet 63 is rotatable. Of course, the fixture 60 may be designed to have a cuboid shape, a cylindrical shape or the like.

An elastic piece 64 is provided at a side of the first and second connecting pieces 61, 62, includes a cut 65, and is connected to the first and second connecting pieces 61, 62 so as to limit positions of the first and second connecting pieces 61, 62. Another elastic piece 69 is provided at a side opposite to the elastic piece 64, is connected to the first and second connecting pieces 61, 62, and also includes a cut 70.

The fixture 60 may rotate downwards around one side wall of the top wall 46 and may be snap-fitted to the receiving chamber 45. The fixture 60 passes through the opening 50 and extends into the receiving chamber 45. When the fixture 60 is snap-fitted to the receiving chamber 45, the first connecting piece 61 may move relative to the second connecting piece 62. As the elastic piece 64 includes a cut 65 and the elastic piece 69 includes a cut 70, a length A of the fixture 60 can vary in a certain range, so that the first connecting piece 61 can move relative to the second connecting piece 62.

In addition, the length A of the fixture 60 is substantially the same as a length B of the receiving chamber 45. A width C of the fixture 60 is substantially the same as a width D of the receiving chamber 45. An exit-stopping projection 54 is provided at an inner surface of the bottom wall 47. When the fixture 60 is snap-fitted to the receiving chamber 45, the end of the fixture 60 abuts against the exit-stopping projection 54, so that the fixture 60 can be fixed in the receiving chamber 45.

An end of the fixture 60 is provided with an unlocking member 66, which is connected to an end of the second connecting piece 62 through a sheet 68, is provided with an unlocking projection 67 and is capable of rotating around the sheet 68.

Preferably, guiding portions are provided to the sides of the openings 50 and 52, and the guiding portions are inclined surfaces to facilitate entry of the inserting member 21 and the fixture 60 into the receiving chamber 45. In addition, an open slot 59 is provided to the top wall 46, and a position-limiting step 57 to the bottom wall 47.

In this embodiment, the fixture 60 is provided to the top wall 46 of the receiving member 40, and the position-limiting projection 54 to the bottom wall 47. In application, the fixture 60 may be provided to the side wall, and the position-limiting projection 54 may be provided to another side wall opposite to the side wall to which the fixture 60 is provided. Alternatively, the fixture 60 may be provided to the bottom wall 47, and the position-limiting projection 54 to an inner surface of the top wall 46, so long as the fixture 60 and the position-limiting projection 54 are provided to two opposite surfaces, respectively.

Figure 11:
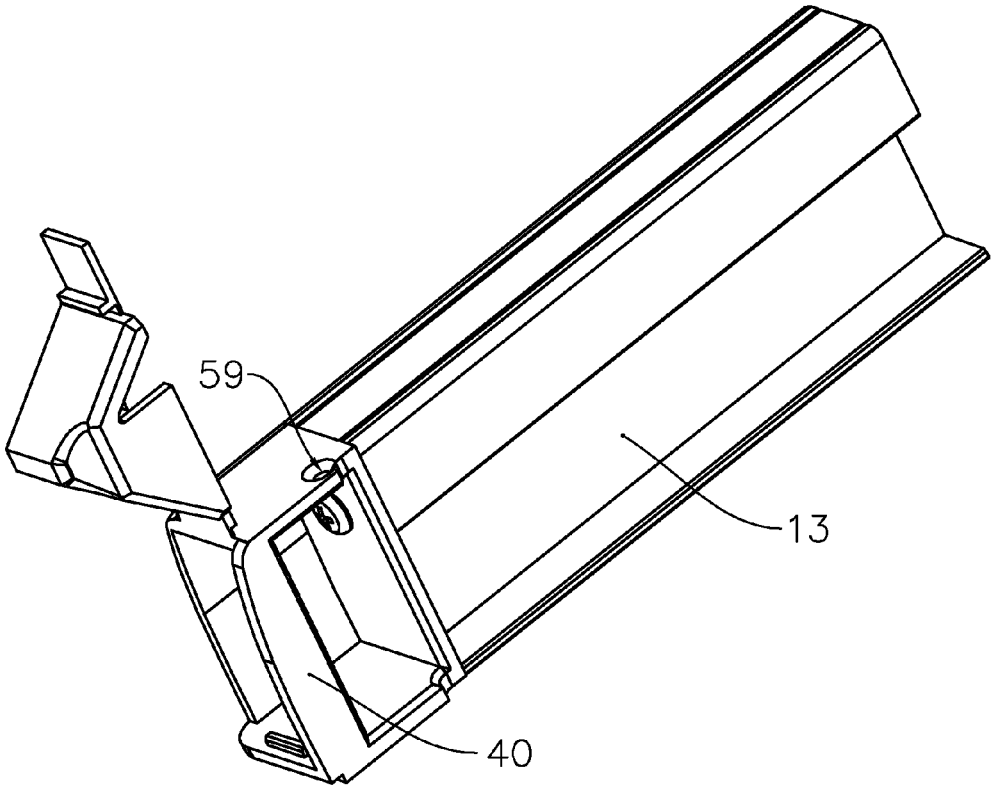
FIG. 11 is a structural view in which a receiving member of the first embodiment of the track corner connecting device for a shower door of this invention is mounted to the second track.

When assembling the shower door frame, the receiving member 40 may be fixed at the end of the second track 13 through the screw 58. An assembled structure is shown in FIG. 11. As the inserting member 21 needs to be inserted into the receiving member 40, the receiving member 40 needs to be elastically deformed to guarantee smooth insertion of the inserting member 21. Preferably, the receiving member 40 is made of an elastic material, such as a material having certain elasticity, strength and tenacity, such as PVC and PA66.

Figure 12:
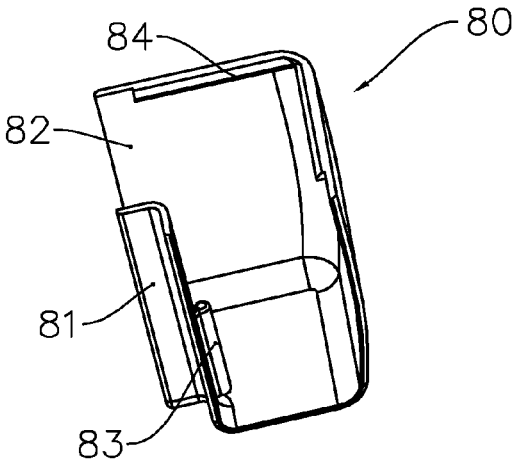
FIG. 12 is a structural view of a decorating cover of the first embodiment of the track corner connecting device for a shower door of this invention.

A decorating cover 80 encapsulates the inserting member 21 and the receiving member 40. As shown in FIG. 12, the decorating cover 80 includes an inner decorating piece 81 and an outer decorating piece 82, an area of the inner decorating piece 81 being smaller than that of the outer decorating piece 82. In addition, a latch 83 is provided at a side of the inner decorating piece 81, and may be inserted into the open slot 33 of the inserting member 21 and the open slot 59 of the receiving member 40 so as to fix the decorating cover 80 outside the inserting member 21 and the receiving member 40.

A lower edge of the outer decorating piece 82 of the decorating cover 80 is provided with an exit-stopper 84, which is in the shape of a barb and may be snap-fitted to the step portion 57 of the receiving member 40 so as to prevent releasing of the decorating cover 80 from the receiving member 40.

Figure 13:
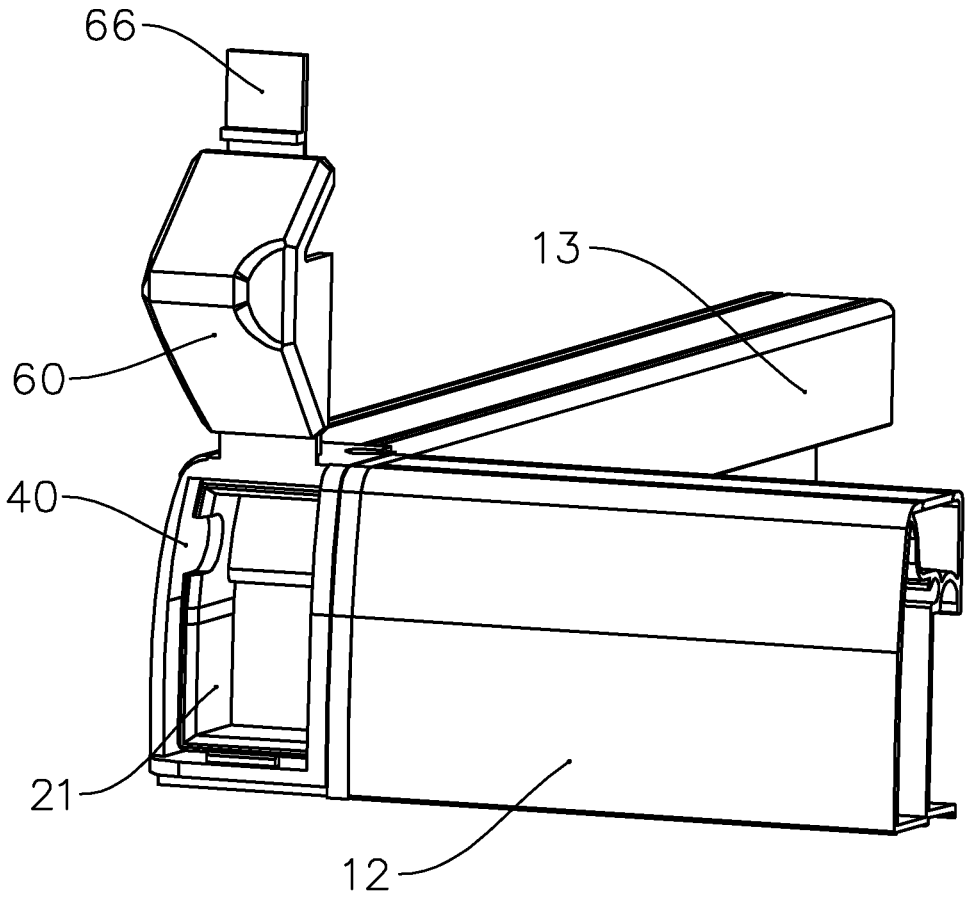
FIG. 13 is a structural view showing an assembled state of the first embodiment of the track corner connecting device for a shower door of this invention.

When assembling the shower door, first, the inserting member 21 is mounted to the end of the first track 12, and the receiving member 40 to the end of the second track 13; then, the inserting member 21 is inserted into the receiving chamber 45 of the receiving member 40; as shown in FIG. 13, the inserting member 21 may pass through the opening 52 of the receiving chamber 45 and may be inserted into the receiving chamber 45, and the opening of the inserting member 21 should face the opening 50 of the receiving chamber 45.

Figure 14:
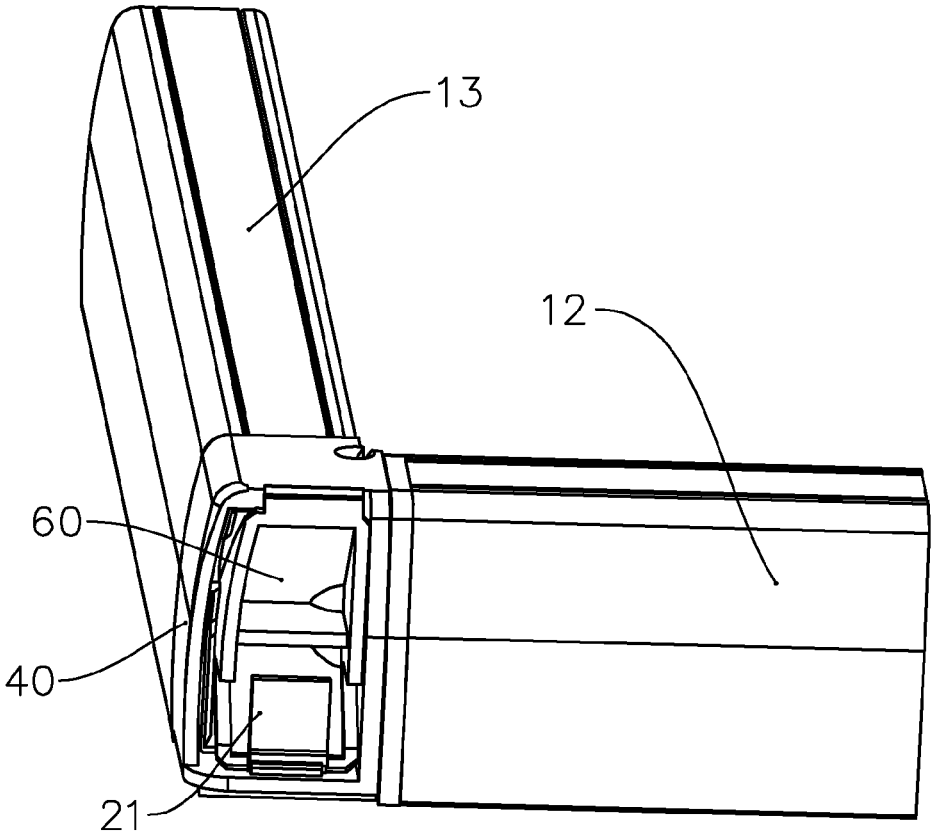
FIG. 14 is a structural view showing the first embodiment of the track corner connecting device for a shower door of this invention in which the decorating cover is omitted.

Afterwards, the fixture 60 is rotated and snap-fitted into the chamber 31 of the inserting member 21. As shown in FIG. 14, the length of the fixture 60 is changed at that time, an end of the fixture 60 abuts against the position-limiting projection 54, and the fixture 60 cannot be released from the chamber 31, thereby fixing the inserting member 21 in the receiving member 40. Finally, the decorating cover 80 is mounted to the receiving chamber 45, the latch 83 of the decorating cover 80 is inserted into the open slot 33 of the inserting member 21 and the open slot 59 of the receiving member 40, and the exit-stopper 84 of the decorating cover 80 is snap-fitted to the step portion 57 of the receiving member 40.

When detaching the connecting device, first, the decorating cover 80 is dismounted; then, the unlocking member 66 of the fixture 60 is caused to rotate around the sheet 68; using a leverage principle, the unlocking member 66 forces the fixture 60 to release from the chamber 31 due to connection of the sheet 68; finally, the inserting member 21 is taken out of the receiving chamber 45, thereby detaching the connecting device.

Second Embodiment

Figure 15:
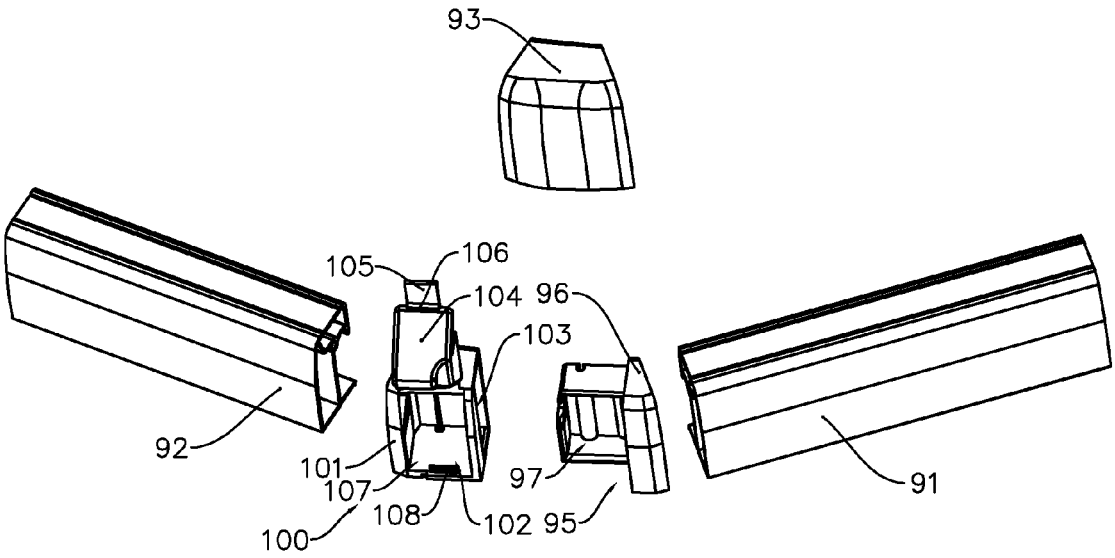
FIG. 15 is a structural exploded view showing a second embodiment of the track corner connecting device for a shower door of this invention and the track.

Referring to FIG. 15, an upper track of the shower door frame of this embodiment includes a first track 91 and a second track 92 with an included angle of 135° formed therebetween. An inserting member 95 is mounted to an end of the first track 91, a receiving member 100 to an end of the second track 92, and the inserting member 95 and the receiving member 100 are encapsulated by a decorating cover 93.

The inserting member 95 includes a body 96 and an insert at a side of the body 96. The insert is formed with a chamber 97 therein and includes an opening. The receiving member 100 has a body 101 and a receiving chamber 102 at a side of the body 101. The inserting member 95 may be inserted into the receiving chamber 102. The receiving chamber 102 includes openings 103, 107 provided at two adjacent side walls. The inserting member 95 may pass through the opening 103 and may be inserted into the receiving chamber 102. A fixture 104 is provided at a top wall of the insert. An end of the fixture 104 is provided with an unlocking member 105 including an unlocking projection 106. A position-limiting projection 108 is provided at a bottom wall of the receiver. The end of the fixture 104 may abut against the position-limiting projection 108 so as to fix the fixture 104 in the chamber 97 of the inserting member 95.

When assembling the shower door frame, the inserting member 95 is fixed to the first track 91, the receiving member 100 to the second track 92, and the inserting member 95 is inserted into the receiving chamber 102. By rotating the fixture 104 and snap-fitting the fixture 104 in the chamber 97, the inserting member 95 is fixed in the receiving member 100, thereby realizing connection between the first and second tracks 91, 92.

As the connecting device of the present invention only includes three parts, namely, the inserting member, the receiving member and the decorating cover, and no screw and tool are required for the assembling of the inserting member and the receiving member, the assembling of the shower door frame is simple and convenient. As the manufacturing cost of the connecting device is low, the manufacturing cost of the shower door can be reduced.

In the above embodiments, the fixture is fixed to the top wall of the receiver by a sheet. In application, the fixture may be fixed to the top wall of the receiver by a pin, a hinge or the like.

INDUSTRIAL APPLICABILITY

The shower door of this invention is installed in a toilet, and acts as an important part of a shower room, which may be an integral shower room having a chassis or a shower room enclosed by the shower door and walls with the shower door installed between two adjacent walls with an included angle therebetween. The shower door of this invention may only include an upper track, or may include both upper and lower tracks. The tracks of the shower door are connected by the above described connecting device.

The shower door of this invention is applicable for on-site assembling in customers' toilets. By applying the product of this invention, installation operations of the shower door are simple, and it does not need screws to fix and connect the two tracks with an included angle therebetween. Therefore, assembling of the shower door requires less time, thereby realizing quick and easy installation of the shower door and reducing the manufacturing and assembling costs of the shower door.

The invention claimed is:

1. A track corner connecting device for a shower door, comprising:

an inserting member and a receiving member, the inserting member being fixedly connected to a first track of the shower door, the receiving member being fixedly connected to a second track of the shower door, wherein:

the inserting member comprises an insert, the insert having a chamber therein and being provided with a first opening;

the receiving member comprises a receiver, the receiver having a receiving chamber therein and being provided with a second opening and a third opening, the second and third openings being arranged on two adjacent walls of the receiver, and the inserting member being capable of passing through the second opening so as to be mounted in the receiving chamber;

the receiving member further comprises a fixture which is arranged at one side of the third opening, is connected to a first wall of the receiver, and is capable of rotating around a side of the first wall of the receiver and being snap-fitted in the chamber of the inserting member; and an exit-stopping projection is provided on a second wall of the receiving member opposite the first wall, an end of the fixture abutting against the exit-stopping projection.

2. The track corner connecting device for a shower door according to claim 1, wherein the end of the fixture is provided with an unlocking member which is connected to the end of the fixture through a first sheet and is capable of rotating around the first sheet.

3. The track corner connecting device for a shower door according to claim 2, wherein the unlocking member is provided with an unlocking projection which is capable of abutting against the exit-stopping projection of the receiving member.

4. The track corner connecting device for a shower door according to claim 1, wherein the fixture comprises a first connecting piece and a second connecting piece that are interconnected, at least one side of the first and second connecting pieces being connected to an elastic piece.

5. The track corner connecting device for a shower door according to claim 4, wherein the elastic piece is provided with at least one cut.

6. The track corner connecting device for a shower door according to claim 1, wherein a side/sides of the first and/or second and/or third openings is/are provided with a guiding portion/guiding portions.

7. The track corner connecting device for a shower door according to claim 1 wherein the fixture is connected to the first wall through a second sheet or a pin.

8. The track corner connecting device for a shower door according to claim 1, wherein at least one first position limiting projection is provided on a surface of the inserting member adjoining the first track.

9. The track corner connecting device for a shower door according to claim 1, wherein at least one second position limiting projection is provided on a surface of the receiving member adjoining the second track.

10. The track corner connecting device for a shower door according to claims 1, wherein the connecting device further comprises a decorating cover encapsulating the receiving member.

11. The track corner connecting device for a shower door according to claim 10, wherein the decorating cover is provided with a latch therein; the inserting member and/or the receiving member is/are provided with an open slot/open slots into which the latch is inserted.

12. The track corner connecting device for a shower door according to claim 10, wherein a lower end of the decorating cover is provided with an exit-stopper, and a lower end of the receiving member is provided with a step portion to which the exit-stopper is snap-fitted.

13. The track corner connecting device for a shower door according to claim 1, wherein the receiving member is made of an elastic material.

14. A shower door frame comprising a track extending in a horizontal direction and a side frame arranged to be perpendicular with the track, the track comprising a first track and a second track with an included angle formed therebetween, the first and second tracks being connected by a connecting device;

characterized in that:

the connecting device comprises an inserting member and a receiving member, the inserting member being fixedly connected to the first track, the receiving member being fixedly connected to the second track;

the inserting member comprises an insert, the insert having a chamber therein and being provided with a first opening;

the receiving member comprises a receiver, the receiver having a receiving chamber therein and being provided with a second opening and a third opening, the second and third openings being arranged on two adjacent walls of the receiver, and the inserting member being capable of passing through the second opening so as to be mounted in the receiving chamber;

the receiving member further comprises a fixture which is arranged at one side of the third opening, is connected to a first wall of the receiver, and is capable of rotating around a side of the first wall of the receiver and being snap-fitted in the chamber of the inserting member; and an exit-stopping projection is provided on a second wall of the receiving member opposite the first wall, an end of the fixture abutting against the exit-stopping projection.

15. The shower door frame according to claim 14, wherein the end of the fixture is provided with an unlocking member which is connected to the end of the fixture through a first sheet and is capable of rotating around the first sheet.

16. The shower door frame according to claim 15, wherein the unlocking member is provided with an unlocking projection which is capable of abutting against the exit-stopping projection of the receiving member.

17. The shower door frame according to claim 14, wherein the fixture comprises a first connecting piece and a second connecting piece that are interconnected, at least one side of the first and second connecting pieces being connected to an elastic piece.

18. The shower door frame according to claim 17, wherein the elastic piece is provided with at least one cut.

19. A shower door comprising a track extending in a horizontal direction and a side frame arranged to be perpendicular with the track, a glass panel being mounted within the side frame, the track comprising a first track and a second track with an included angle formed therebetween, and the first and second tracks being connected by a connecting device;

characterized in that:

the connecting device comprises an inserting member and a receiving member, the inserting member being fixedly connected to the first track, the receiving member being fixedly connected to the second track;

the inserting member comprises an insert, the insert having a chamber therein and being provided with a first opening;

the receiving member comprises a receiver, the receiver having a receiving chamber therein and being provided with a second opening and a third opening, the second and third openings being arranged on two adjacent walls of the receiver, and the inserting member being capable of passing through the second opening so as to be mounted in the receiving chamber;

the receiving member further comprises a fixture which is arranged at one side of the third opening, is connected to a first wall of the receiver, and is capable of rotating around a side of the first wall of the receiver and being snap-fitted in the chamber of the inserting member; and an exit-stopping projection is provided on a second wall of the receiving member opposite the first wall, an end of the fixture abutting against the exit-stopping projection.

20. The shower door according to claim 19, wherein the end of the fixture is provided with an unlocking member which is connected to the end of the fixture through a first sheet and is capable of rotating around the first sheet.

* * * * *